US005134826A

United States Patent [19]

La Roche et al.

[11] Patent Number: 5,134,826

[45] Date of Patent: Aug. 4, 1992

[54] STRUCTURAL PANEL CONNECTOR FOR SPACE DIVIDING SYSTEM

[75] Inventors: Robert La Roche, Verdun; Martin Chenette, Notre Dame Ile Perrot, both of Canada

[73] Assignee: Precision Manufacturing, Inc., Quebec, Canada

[21] Appl. No.: 689,515

[22] Filed: Apr. 23, 1991

[51] Int. Cl.[5] ..... F04B 2/76

[52] U.S. Cl. ..... 52/584; 52/239; 52/281; 52/282

[58] Field of Search ..... 52/239, 281, 282, 584

[56] References Cited

U.S. PATENT DOCUMENTS

| | | | |
|---|---|---|---|
| 3,818,661 | 6/1974 | Pragg, III | 52/282 |
| 4,104,838 | 8/1978 | Hage et al. | 52/239 |
| 4,424,654 | 1/1984 | Anderson et al. | 52/239 |
| 4,625,483 | 12/1986 | Zacky et al. | 52/239 |
| 4,638,614 | 1/1987 | Wilcox | 52/239 |
| 4,716,699 | 1/1988 | Crossman et al. | 52/239 |
| 4,805,365 | 2/1989 | Bastian | 52/282 |
| 4,860,812 | 8/1989 | DePietro et al. | 52/239 |
| 4,942,713 | 7/1990 | Jackson | 52/584 |
| 4,962,805 | 10/1990 | Allen | 52/239 |

*Primary Examiner*—Michael Safavi
*Attorney, Agent, or Firm*—Longacre & White

[57] ABSTRACT

A panel connector for interconnecting and supporting panels along their side edges to form space divisions. The panel connector comprises a structural connecting post having a supporting bottom end and a securing top end. The connecting post has opposed parallel side walls with a first pair of side walls having hook receiving apertures spaced in groups along the connecting post. A clamp bracket is secured in the top corner of at least one panel to be secured to the connecting post. A clamp is associated with the bracket and has a hooking element which engages with the apertures in the top end of the connecting post and with hook cavities in the clamp bracket to rigidly connect the panel to the connecting post. The side edge of the panel is also provided with a hooking clamp spaced from the top end to engage with further hook receiving apertures provided along the connecting post.

29 Claims, 11 Drawing Sheets

FIG. 6
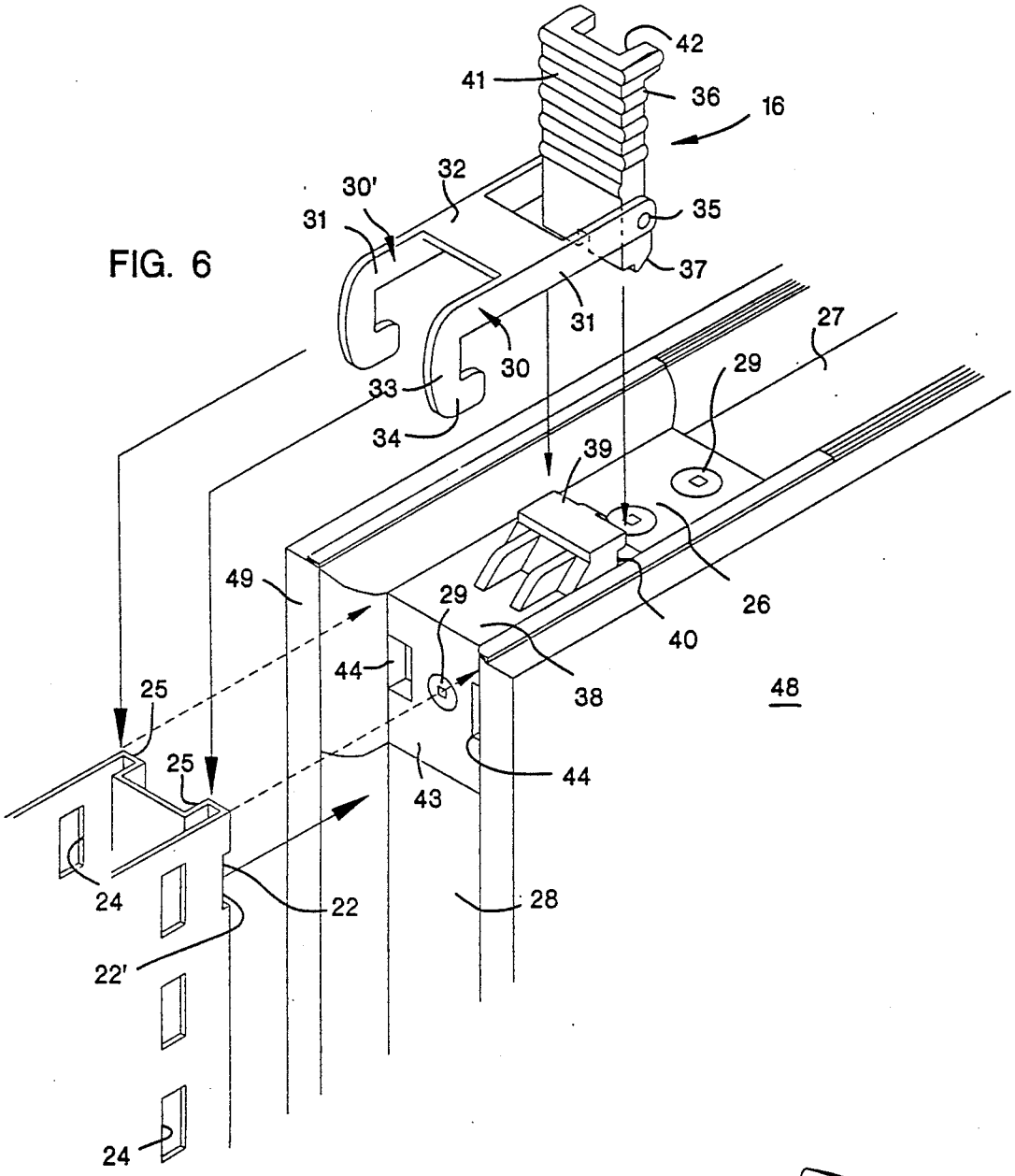
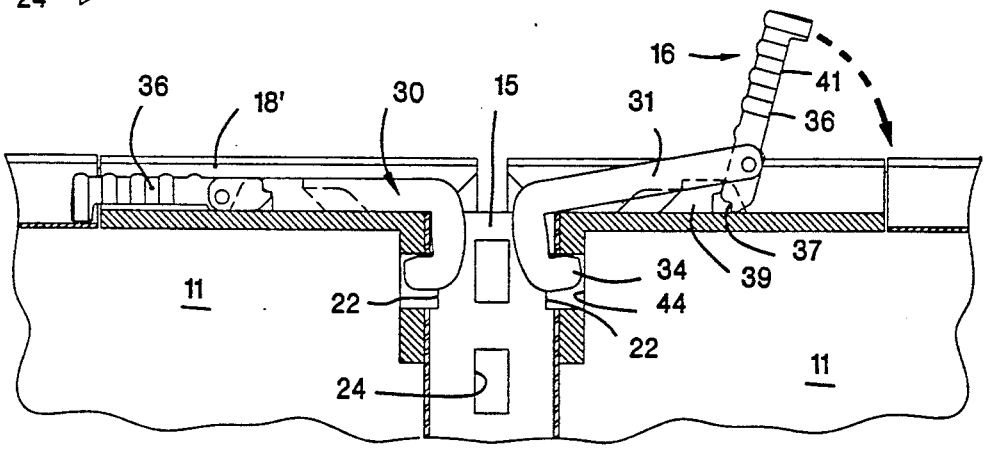
FIG. 7

STRUCTURAL PANEL CONNECTOR FOR SPACE DIVIDING SYSTEM

BACKGROUND OF INVENTION

1. Field of Invention

The present invention relates to a structural connecting post and clamping connectors to secure space division panels thereto as well as for supporting articles of furniture in front of the panels and permitting change of height and stackability of panels and wherein no tools are required to assemble one or more panels to the connecting post.

2. Description of Prior Art

Various connecting mechanisms and panel systems have been provided to divide a space into working sub-areas and wherein desks, cabinets and other components are integrated with the partition walls. Various means of connecting the partition walls have been suggested and such systems are for example described in U.S. Pat. No. 4,567,698. Many of such systems lack versatility and flexibility and are usually unstable. Some of the prior art connectors also act like hinges and make the panels unstable and this is a major drawback, particularly with panels where shelving, filing cabinets or other such articles of furnitures are secured thereto. This loading of the panels will stresses the connecting joints and result in eventual breakage. Usually, the panels are connected at two attachment points along their vertical side edges with one connecting point at the top and the other at the bottom of the panels. Existing panel systems are also designed to be of a common height and a change in the height is usually impossible or very complex to achieve, often requiring a complete reassembly of the system and rendering the system unstable.

Other disadvantages of known space division cations thereof can only be done by experienced personnel thus preventing the user from modifying his space division walls. Existing panel modules also do not stack one over another in a vertical plane, nor do they come in varying sizes or designs and constructions to create various surface treatment or to simply raise the height of an actual installation.

There is usually two types of panel systems, the first one being the straight panel of rectangular shape that interconnects at a given height. It is difficult with such a system to do a height change in the panels. When this is required, the manufacturer is often asked to provide special components and this becomes costly and time consuming to install.

The other type of panel system is a panel frame to which is added tiles. The panel is usually an empty metal frame available in limited widths and heights and on which tiles are added on the surface to finish the panel and create a visual or functional effect. Height changes are easy in a straight row of panels but much more difficult when the panels are disposed at an angle to one another. These panels are also not stackable in a common vertical plane.

Most panels of the prior art are difficult to assemble and often require special tools. Their assembly is also time consuming and they cannot be easily modified after they have been erected in a space division system. They also do not provide flexibility for add-ons and often it is required to disassemble a large section of the space division to make a small modification.

SUMMARY OF INVENTION

It is a feature of the present invention to provide a panel connector which substantially overcomes all of the above-mentioned disadvantages of the prior art.

A further feature of the present invention is to provide a panel connector comprised of a structural connecting post which is the structural element in the space dividing system for supporting panels, shelving, or other articles of furniture and the entire weight of the system is transferred to ground through the connecting post.

Another feature of the present invention is to provide a panel connector having a structural connecting post and to which panels are secured in a top end by a removable clamp and further at spaced intervals along the length of the post to provide a rigid connection with the panels.

Another feature of the present invention is to provide a panel connector which can be constructed in sections to provide adjacent panels of different heights and wherein panels can be connected one on top of each other in a vertical plane along the post and further wherein panels of different heights and design can be secured to the connecting post.

Another feature of the present invention is to provide a panel connector for interconnecting and supporting panels along their side edges to form a space division and wherein the panels are connected to the post without the use of screws or special tools.

A further feature of the present invention is that the panel is not a structural element in the space dividing system, and is supported elevated (floating). Accordingly, it can be of light weight construction making it easy to install.

Another feature of the present invention is to provide a panel connector having a structural connecting post which is provided with a leveling foot at the bottom end thereof and wherein the foot is easily adjustable to adjust its height and wherein the foot grips the floor surface on which it is positioned.

Another feature is to provide hooks along the side edges of the panels so that the panels can be attached to the connecting posts quickly to form the divisions, and thereafter the clamps can be engaged. Accordingly, the panels are self-supporting without the clamps permitting repairs to the clamps, if necessary.

Another feature of the present invention is to provide a panel connector having a structural connecting post to which end connecting blocks are secured whereby to connect to other connecting posts and dispose panels at angles to one another.

According to the above features, from a broad aspect, the present invention provides a panel connector for interconnecting and supporting panels along their side edges to form a space division. The panel connector comprises a structural connecting post having a supporting bottom end and a securing top end. The connecting post has opposed parallel side walls. The first pair of the side walls has panel attachment means in at least one side thereof and the second pair of side walls has a plurality of connecting means in at least one of its opposed side walls. A clamp bracket is securable in the top corner of at least one panel to be secured to the connecting post. A clamp is associated with the bracket and has fastening means to rigidly connect the panel attachment means to the clamp bracket to lock the panel with the connecting post. The clamp has a pivoting lever to permit the fastening means to be located in engagement with the attachment means of the connecting post and into the arresting means of the clamp bracket whereby to urge a side edge of the panel firmly against the side wall of the first pair of side walls of the connecting post. Hooking means is secured to a connecting vertical edge of the panel for engagement with the panel attachment means and spaced from the top corner of the panel.

According a further feature of the invention, there is provided a panel connector comprised of a structural connecting post and clamps to secure panels to the post and designed to allow maximum flexibility to a space division system and which represents a significant advance in terms of steadiness, ease of assembly and layout flexibility. The panel system of the present invention using the novel connector allows to erect a panel layout at a prefixed height with basic panels and incorporates rows of panels having lower heights to provide visual access or at much higher heights to provide standing privacy. The system also permits different types of panels to be incorporated in a single plane to provide panels for ventilation and visibility through the wall.

BRIEF DESCRIPTION OF DRAWINGS

Other features and advantages of the present invention will become apparent from the following description with reference to the accompanying drawings which illustrate a preferred embodiment of the present invention and wherein:

FIG. 6 is an enlarged perspective view, partly exploded, illustrating the construction of the clamp and the clamp bracket secured to a corner of a panel and its manner of securement to a top end of a structural connecting post;

FIG. 7 is a fragmented side view, partly sectioned, showing the clamp connection of adjacent aligned panels to a structural connecting post;

DESCRIPTION OF PREFERRED EMBODIMENTS

Figure 1:
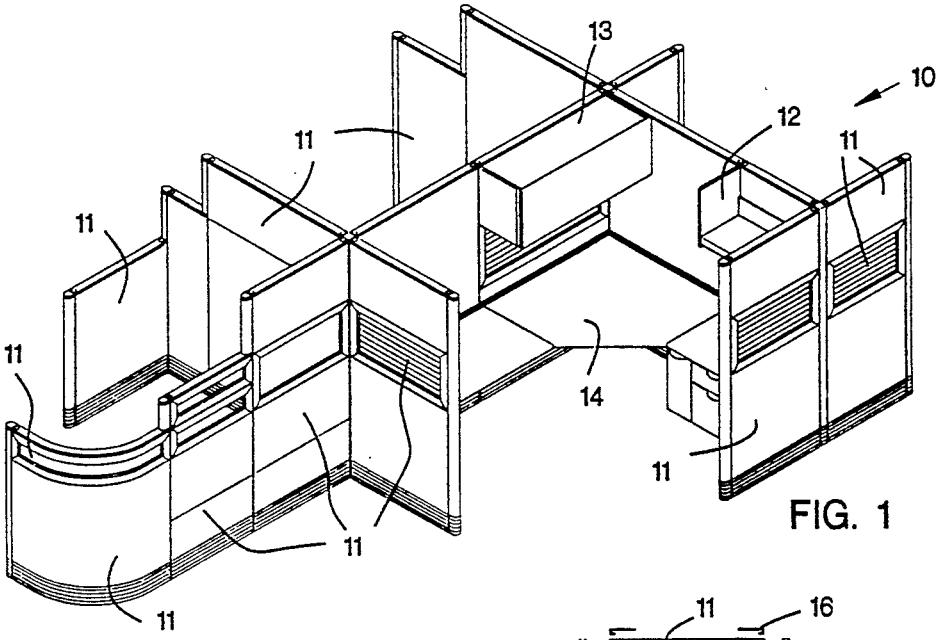
FIG. 1 is a perspective view showing a division system constructed with the panel connector of the present invention.

Referring to the drawings, and more particularly to FIG. 1, there is shown generally at 10, a space division system comprised of a plurality of panels 11 of different size, shape and construction, all interconnected to one another by the panel connector of the present invention. As herein shown, furniture modules such as shelf units 12, cabinet 13, and desk top 14 are all supported directly by the panel connector of the present invention and accordingly no load is attached to the panels themselves. As herein shown, panels of different height and construction are connected one on top of another in a common plane and the manner in which these are connected will be described later on.

Figure 2:
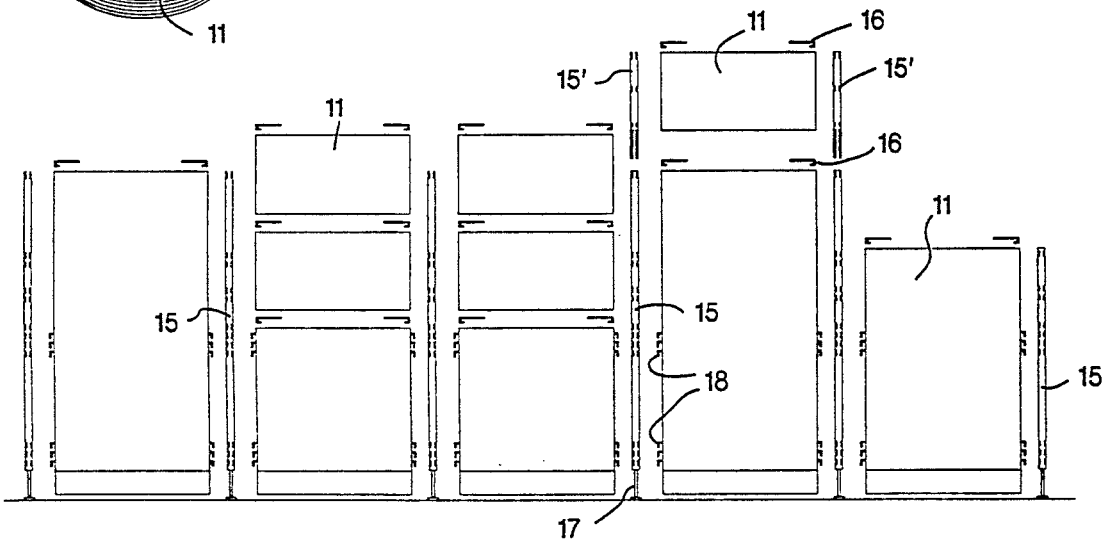
FIG. 2 is a side view showing the basic elements of a division system constructed with the panel connector of the present invention.
Figure 3:
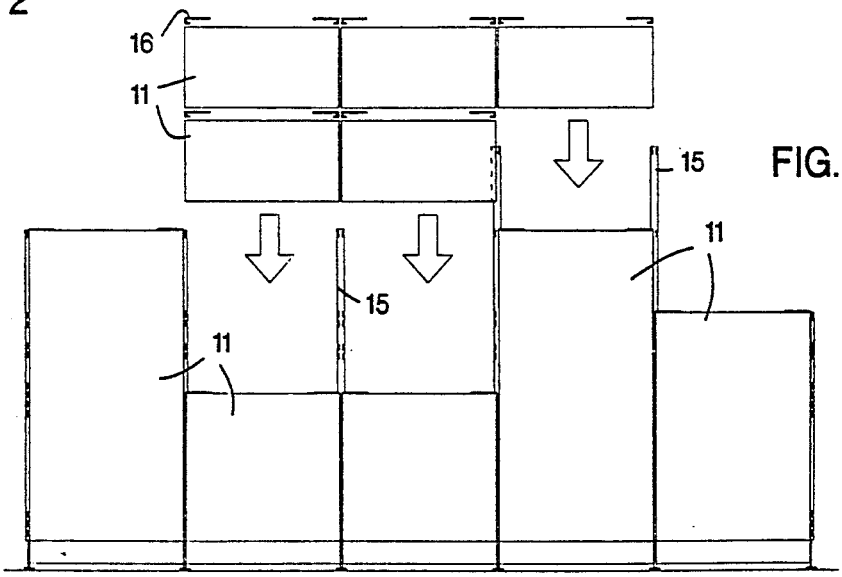
FIG. 3 is a side view similar to FIG. 2, illustrating the assembly of the panels to the structural connecting posts.
Figure 4:
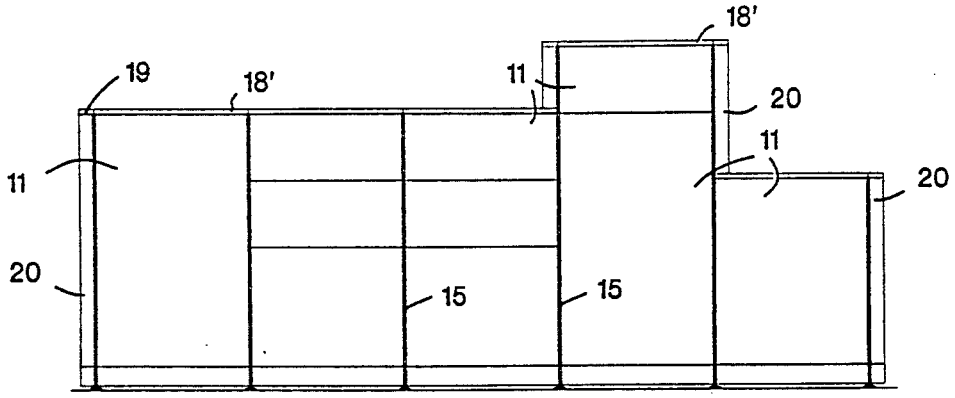
FIG. 4 is a side view showing the assembly of FIGS. 2 and 3 in a completely assembled form.

Referring now additionally to FIGS. 2 to 4, there is illustrated the basic component parts of a division system constructed with the panel connectors of the present invention. The panel connector of the invention comprises structural connecting posts 15 and these may provided as a single post length or may comprise of post sections 15'. The panels 11, herein panels of different size, are interconnected to the posts by a clamp 16 provided in the top end of the panels. At the bottom end of the connecting post 15, there is also provided a leveling foot 17 to adjust the level of the panels after they are secured to the connecting posts 15. Some of the panels are also provided with clamp brackets 18 which hook to the structural connecting posts 15 intermediate the ends of the posts to provide for a rigid connection with the post both axially and laterally. As shown in FIG. 3 the panels are assembled in sequence from the bottom ones to the top ones. The bottom edge of the panels are supported elevated from the floor surface, and such are known as "floating" panels. This provides for ease of adjustment. Once completed, the exposed end edges and top edges of the panels and connecting posts are covered by panel top covers 18' connector end caps 19 and side covers 20 to form an aesthetically pleasing assembly.

A detailed description of the panel connector of the present invention now follows with specific reference to FIGS. 5 to 8D. As herein shown, the structural connecting post is a straight elongated post of substantially square cross-section and defines a first pair of side walls 21 having panel attachment means in at least one of the side walls, as herein shown in both side walls with the said attachment means being constituted by hook receiving apertures 22. As herein shown there are four groups of hook receiving apertures 22 along the post 15. The other pair of post side walls 23 are provided with a plurality of equidistantly spaced connecting slots 24 to which articles of furniture such as the shelf 12, cabinet 13, and desk top 14, may be connected.

Figure 5:
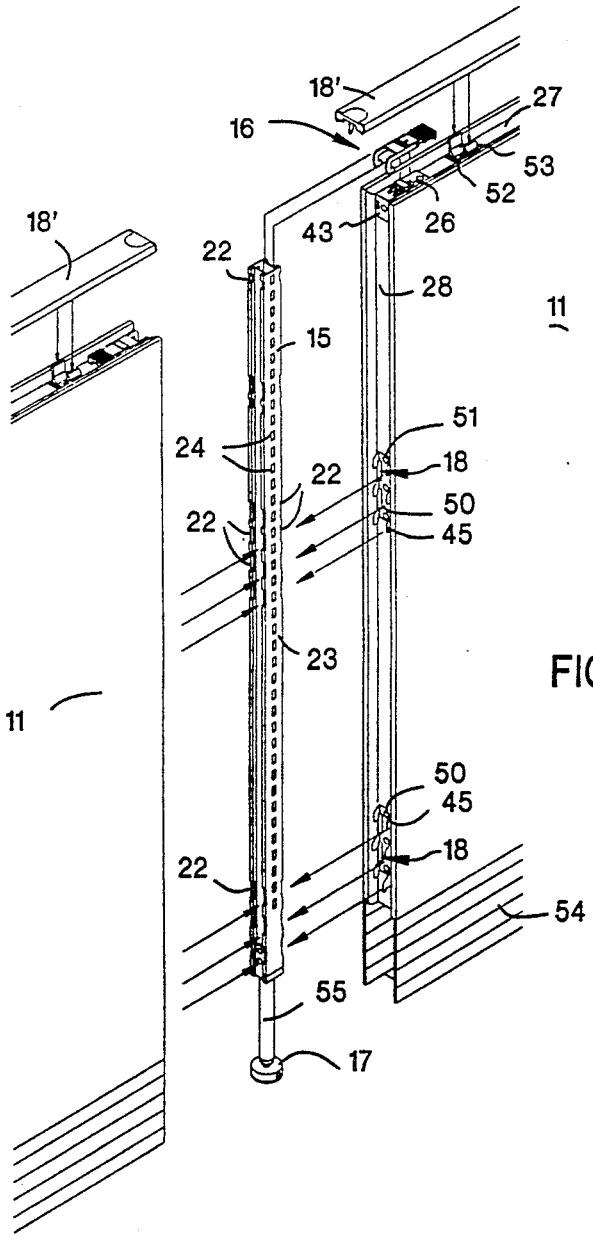
FIG. 5 is an exploded perspective view illustrating the panel connector of the present invention as utilized to interconnect two adjacent panels in a common plane.

The structural connecting post 15 is provided with inner end channels 25 formed integral therewith along corner areas of the first pair of side walls with the channels 25 forming protrusions extending outwardly of the side walls 21. The hook receiving apertures 22 are formed in a forward end portion of these channels 25. The hook receiving apertures 22 are also formed in aligned pairs in the outer end portions of these channels and transversely aligned with one another. The reason for these hook receiving apertures is to interconnect the post with the panels 11. As previously described, a clamp is utilized in the interconnection. As shown in FIGS. 5 and 6, a clamp bracket 26 is secured in a top corner of the top edge 27 and side edge 28 of the panel 11. The clamp bracket is secured by fasteners 29. The clamp 16 is herein shown as a detachable clamp but it is conceivable that it could be permanently secured to the top wall of the clamp bracket and it is comprised by a pair of hooking fingers 30 and 30' which are formed from a flat metal plate and disposed spaced apart in parallel relationship. These fingers each have a straight connecting arm 31 and a common interconnecting wall 32 and define hooking fingers formed by a bridge wall 33 and inwardly turned end fingers 34 spaced parallel to the connecting arms 31. The connecting arms 31 are further pivotally connected by a pivot connection 35 at a free end thereof to a pivoting lever 36. The pivoting lever 36 is provided with a wedge end 37 extending forwardly thereof.

Figure 8A:
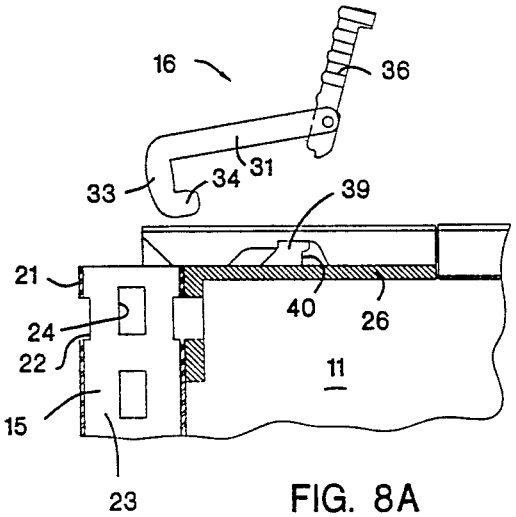
FIGS. 8A to 8D are fragmented, partly sectioned, side views illustrating the operation of the clamp to connect a structural panel to the top end of a structural connecting post.
Figure 8B:
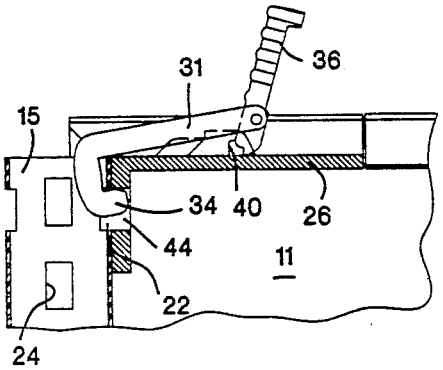
Figure 8C:
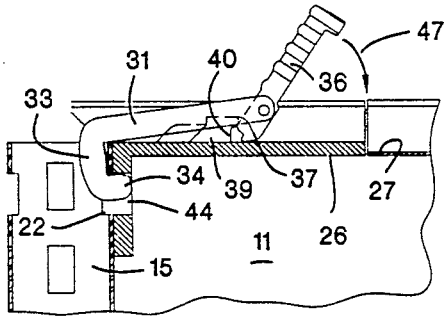
Figure 8D:
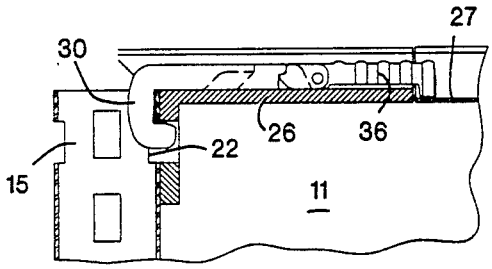

As better illustrated in FIG. 6, the top wall 38 of the clamp bracket 26 has a clamp post 39 extending post 39 is provided with an undercut abutment wall 40 for receiving the wedge end 35 of the pivoting lever in locking engagement therewith, as illustrated in FIGS. 8A to 8D. The lever 36 has a finger engaging end portion 41 and a slot aperture 42 is formed in a free end wall thereof to permit entry of a wedging tool, such as a from the top edge 27 of the panel 11 when it is in a clamping position, as shown in FIG. 8D. By wedging the pivoting lever upwardly, it will snap open to cause it to disconnect with the connecting post.

As shown in FIG. 6, the clamp bracket 26 is a right-angle bracket and defines a connecting end face 43 provided with a pair of hook receiving cavities 44 constituting an arresting means for the hooking fingers 30. As previously described, the side edge 28 of the panel 11 is provided with one or more clamp brackets 18. Each clamp bracket is provided with one or more pairs of hooking fingers 45 projecting therefrom to engage with two or more pairs of hook receiving apertures 22 provided in the post 15. Accordingly for securing the panel to the post, one firstly positions the hooking fingers 45 within respective ones of the apertures 22 in the top end of the post aligned with the top edge 27 of the panel 11.

As shown in FIG. 8A, the clamp, which is herein a separate element, is positioned with the hooking fingers 34 extending inside the post with the finger end 34 extending through the top aperture 22', as shown in FIG. 6, and entering into the hook cavities 44, as shown in FIG. 8B. The wedge end 35 is positioned behind the clamp post 40 and the pivoting lever is pushed downwardly towards the top edge 27 of the panel, in the direction of arrow 47, as shown in FIG. 8C. This causes the bridge wall 33 of the hooking fingers to urge the post and panel in clamping engagement, as shown in FIG. 8D. The hooking fingers 30, being located in the hook cavities 44 prevent lateral movement of the panel with the connecting post. Also, as shown in FIG. 6, the top edge and side edge of the panel are recessed from the panel front wall 48 and rear wall 49 thereby further preventing lateral movement. However, the main reason for the hook receiving cavities 44 is to prevent axial displacement between the post and the panel. When the hooking fingers are received in the hook receiving cavities, the hooking fingers 45 of the clamps 18 can no longer move out of their respective hook receiving apertures 22. The hook plates 18 have a flat connecting wall 50 having holes therein to receive fasteners 51 to secure it to the panel side edge 28.

As shown in FIG. 5, the top edge 27 of the panel 11 is provided with clips 52 having opposed flexible prongs 53 to retain in snap-fit therewith the panel top cover strips 18' to provide an aesthetic finish to the panels. The top cover strips 18' extend over the clamp assemblies 16. As herein shown, the bases of the panels are also provided with a hollow base channel 54 to run communication and electrical cables therein, as is with a support extension post 55 to which is connected the leveling foot 17. As shown in this Figure, there are two clamp brackets 18 in the side edge 28 of the panels 11. These clamp brackets provide for a stable connection of the panels with the posts, and further 15 without using the clamp 16. Once the space division set-up is completed, the clamps 16 are then engaged. Accordingly, the system is more flexible and faster to install and modify.

Figure 9A:
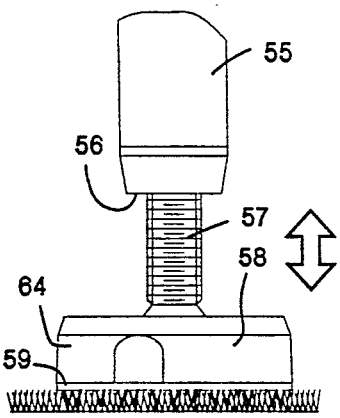
FIG. 9A is a side view of a leveling foot adjustably connected to the bottom end of a connecting post.
Figure 9B:
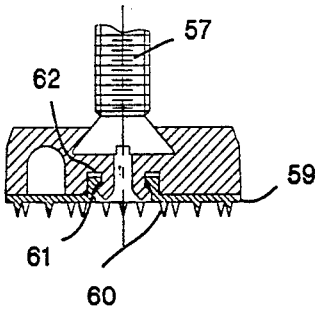
FIG. 9B is a section view illustrating the construction of the leveling foot.
Figure 9C:
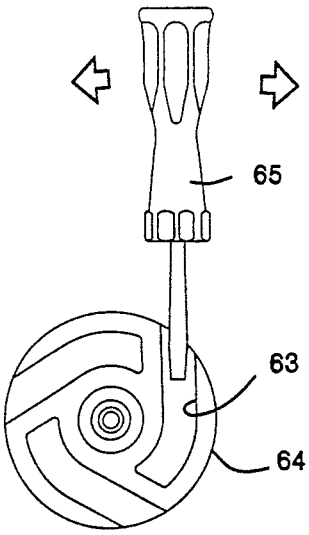
FIG. 9C is a top section view illustrating the manner of adjustment of the leveling foot.

Referring now to FIGS. 9A, 9B and 9C, there will be described the construction and operation of the leveling foot. As herein shown, the leveling foot is provided with an adjustment screw 57 which is in threaded engagement with a threaded bore (not shown) provided in a lower end of the extension post 55. The adjustment screw 57 is secured to a rotatable block 58 which is rotatably supported on a gripper base 59. The gripper base 59 is a flat nylon disc having sharp cone-shape prongs 60 formed integral therewith and extending from a lower surface thereof to constitute a gripper means to prevent shifting or lateral displacement of the leveling foot on a support surface which is usually carpeted surface. The nylon disc 59 is also formed with a sleeve connector 61 extending above a top surface thereof and which is received in rotatable engagement within an annular groove formed in a bottom face of the rotatable block 58.

The rotatable block is also provided with two or more, herein three tangential bores 63 in the side wall 64 thereof for the insertion of a rod-like element, such as the screwdriver 65, therein to rotate the block 58 on the gripper base 59 which remains stationary by the prongs 60 firmly engaged in the support surface. Accordingly, the screw 57 can be rotated and the level of the panels connected to the post can be adjusted.

Figure 11A:
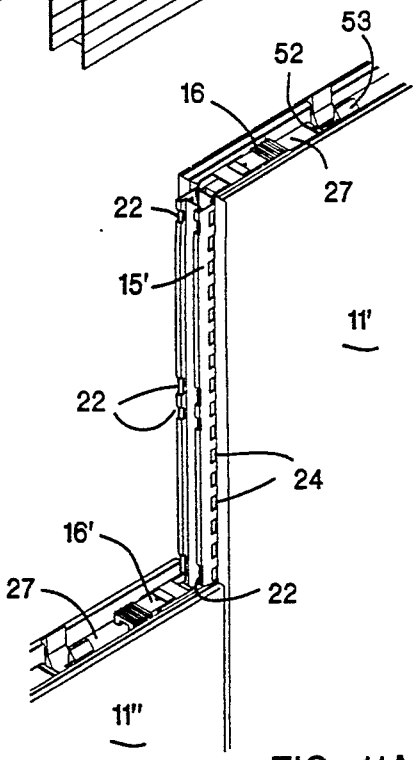
FIGS. 11A to 11C are fragmented perspective views showing panels of different heights connected to a common structural connecting post.
Figure 11B:
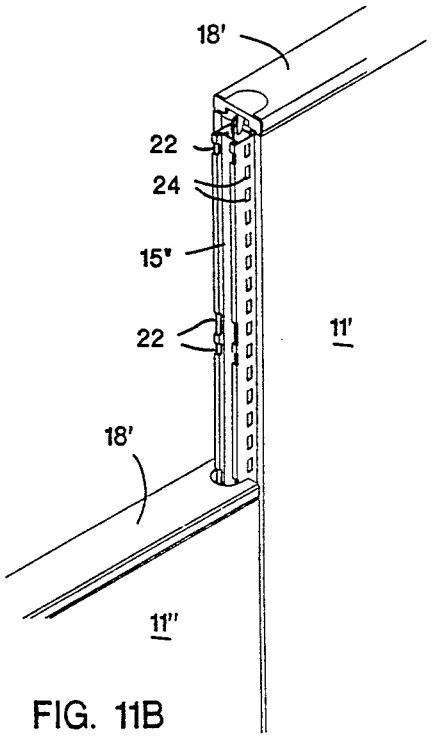
Figure 11C:
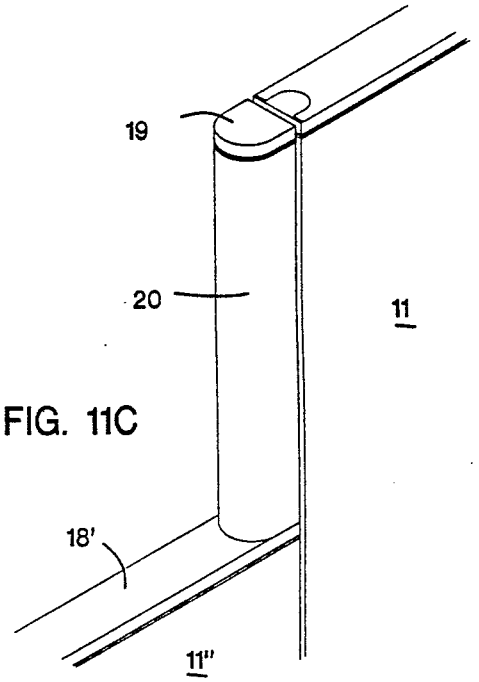
Figure 12B:
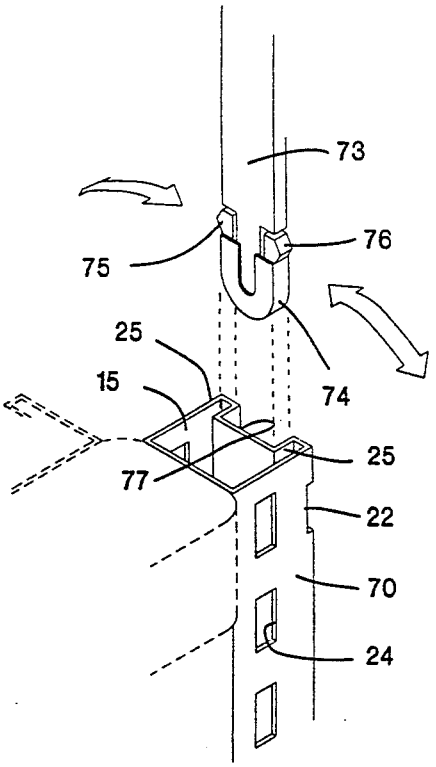
FIG. 12B is a perspective view showing the interconnection of the connector post sections.
Figure 14A:
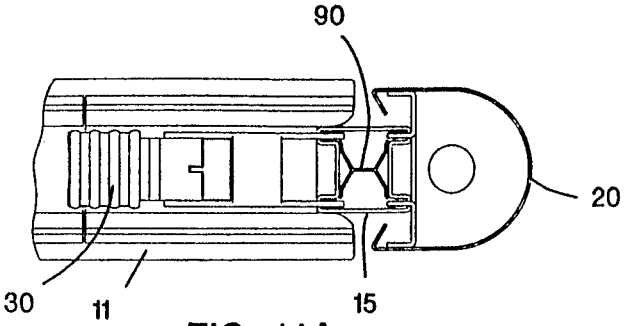
FIG. 14A is a top view showing an end connector having a termination cover secured thereto.
Figure 14B:
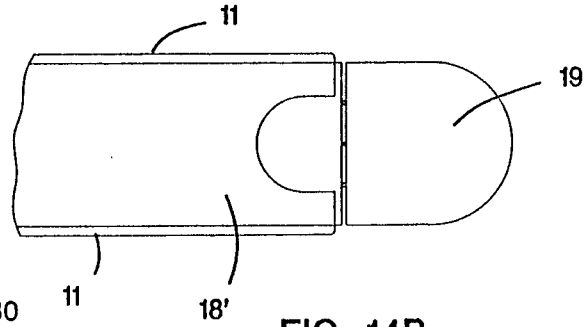
FIG. 14B is a top view similar to FIG. 14A but showing the top panel cover and end cap secured in position.

As previously described, panels of different heights may be connected to a common structural connecting post as is illustrated in FIGS. 11A to 11C. As herein shown, the panel 11' is a taller panel than panel 11" with panel 11" terminating at an intermediate group of hook receiving apertures 22 and being secured thereto by the clamp assembly 16'. Accordingly, both panels are rigidly interconnected to the common connecting post 15'. The panel top covers 18' are then secured to the top edge of both panels 11' and 11", as shown in FIG. 11B. Thereafter, a short side cover 20 is secured to the hook receiving apertures 22 in the top portion 15" of the post 15' in a manner as illustrated in FIG. 14A. The connector end cap 19 is then snap-fitted into position. Accordingly, an aesthetic configuration of two panels of different heights is created. This configuration can also be created with the panels extending at right angles, as shown with further reference to FIGS. 12A to 12C. As herein shown the connecting post is formed of connecting post sections 70 and 71 with the section 71 accommodating the longer panels sections 72. One of the connecting sections 70 or 71, herein the top section 71 has a straight anchor tongue 73 welded between the end channels 25 in one of the side walls 21. The anchor tongue has an anchor bushing 74 secured to a free end thereof, the bushing being formed of a plastic material and defining two opposed flexible arms 75 each having an respective one of the hook receiving apertures 22' provided at the top of the lower connecting post section 70. As herein shown, the tongue member 73 is a flat rectangular member which fits within the cavity 77 defined between the end channels 25. The length of the tongue member 73 is such that the engaging shoulders 76 will engage under a pair of hook receiving apertures when both ends of the bottom and top connecting post sections meet. A side cover section 20 and connector end cap 19 is then secured about the upper connecting post section 71, as shown FIG. 12C and the panel top covers 18' are snapped into position to produce an aesthetically finished product.

Figure 12A:
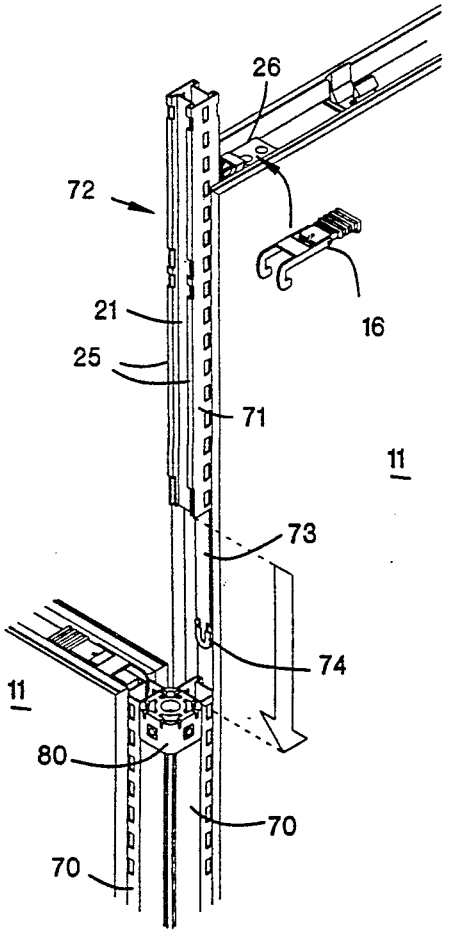
FIG. 12A is an exploded perspective view showing a structural connecting post of the present invention constructed with connecting post sections.
Figure 12C:
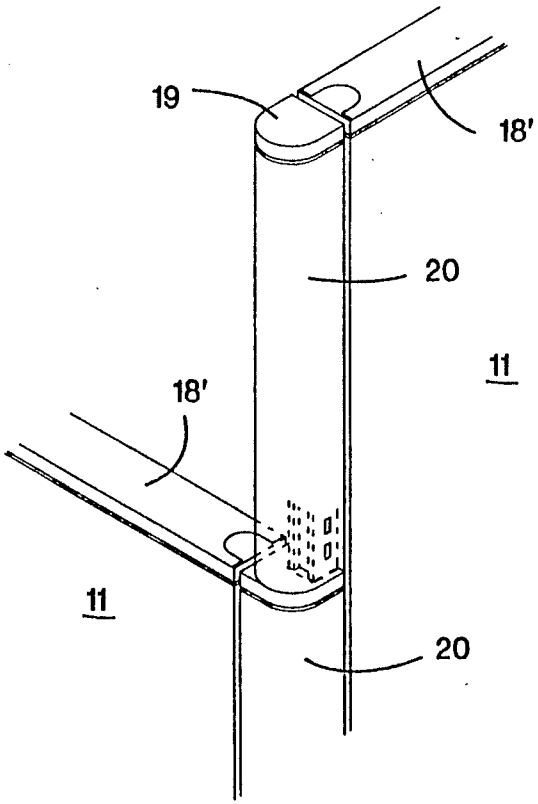
FIG. 12C is a view similar to FIG. 12A but showing the connectors covered by connector covers and caps.
Figure 15A:
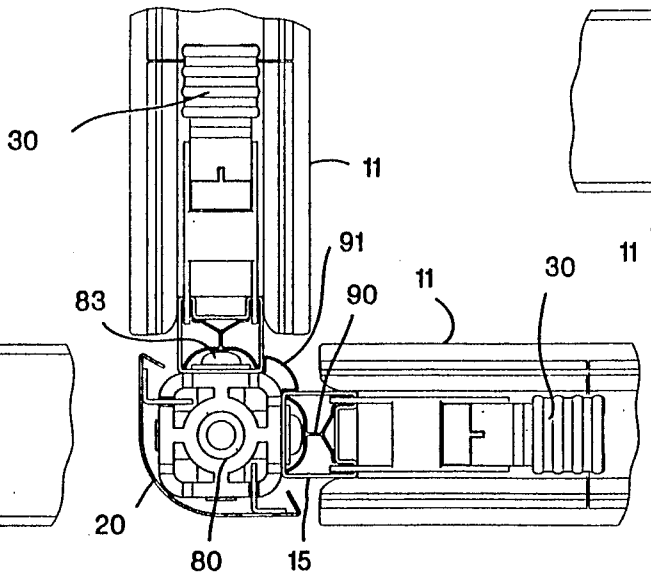
FIG. 15A is a top view showing two panel connecting posts connected to a connector block with the panels extending at right angles to one another and an angulated cover concealing the connector blocks and connectings posts.
Figure 15B:
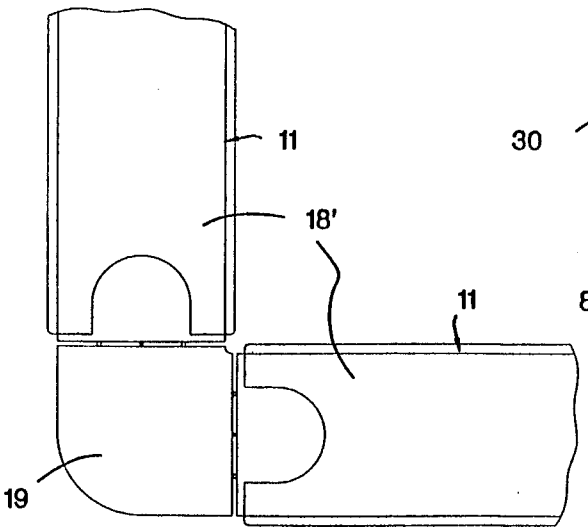
FIG. 15B is a top view similar to FIG. 15A showing the panel covers and connector caps in position.
Figure 17A:
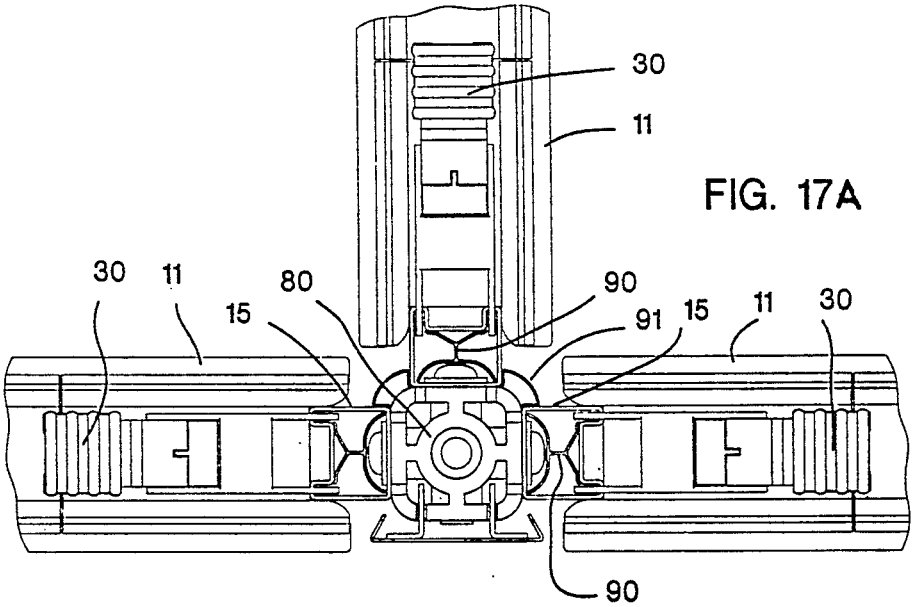
FIG. 17A is a top view showing three connecting posts each secured to a respective panel and interconnected to one another by a connecting block with a cover strip secured to the open side of the connecting blocks to form a T-connection.
Figure 17B:
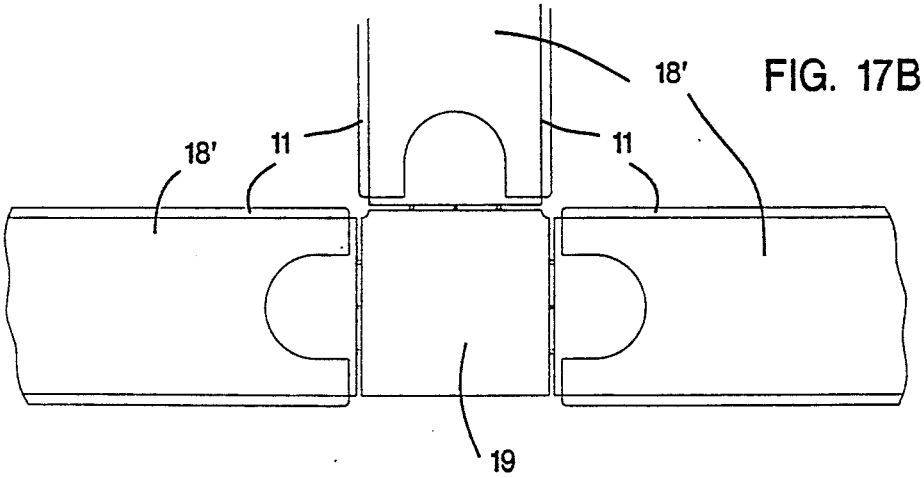
FIG. 17B is a view similar to FIG. 17A but showing the panel top covers and end caps in position.
Figure 18B:
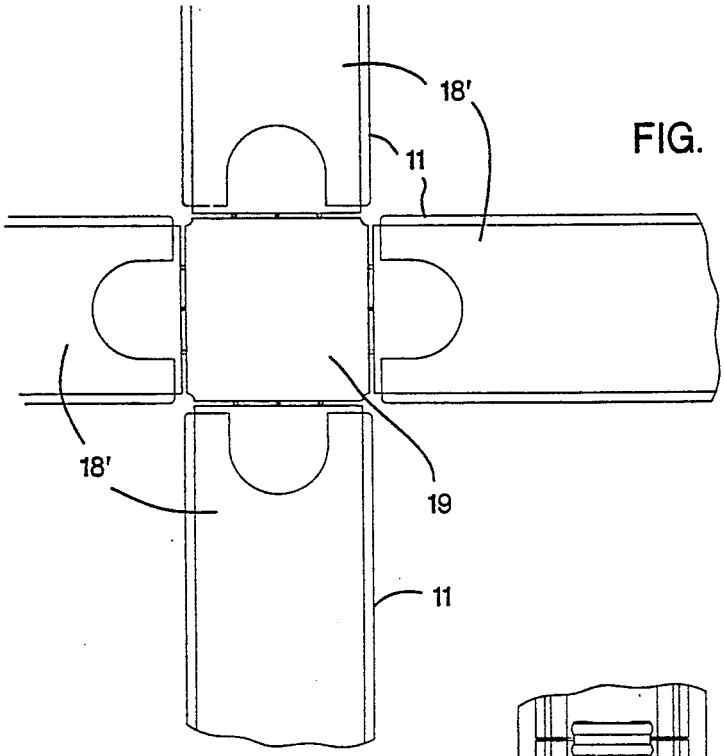
FIG. 18B is a top view of FIG. 18A but showing the panel top covers and the connector end caps in position.
Figure 18A:
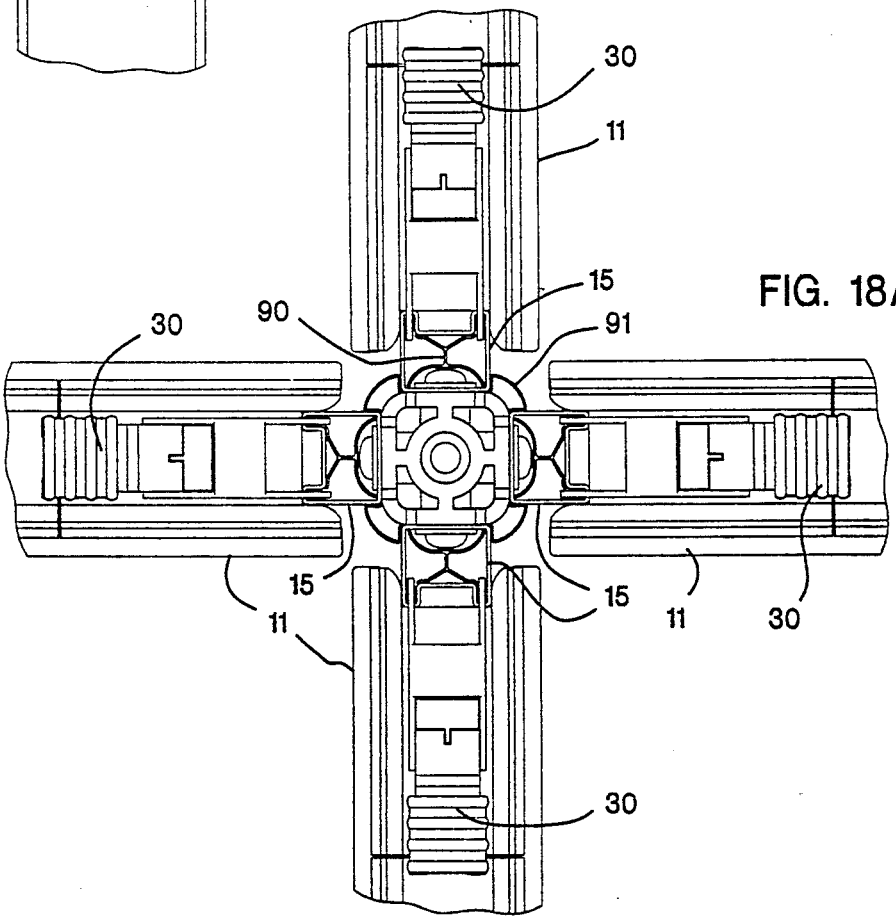
FIG. 18A is a top view showing four panels in a star connection configuration and wherein four connecting posts are secured to connecting blocks to interconnect them together.

As shown in FIG. 12A, the structural connecting posts 70 are interconnected at right angle to one another by two or more interconnecting rectangular blocks 80. The configuration of the block 80 is better illustrated in FIG. 13A where two panels 11 and 11' are connected in planar alignment but spaced from one another by the interconnecting blocks 80. These blocks are connected to flat outer side walls 81 of opposed connecting posts 82 by conventional fastening means 83. The connecting blocks 80 have opposed parallel connecting faces 84 with the faces having pairs of aligned slots 85 therein and threaded bores 86 to connect to the connecting posts 82. Accordingly, through these connecting blocks 80, panels can be interconnected together to form L-shape or right-angle corners as shown in FIG. 15A or to form a T-configuration as shown in FIG. 17A. FIGS. 15A and 17A will not be described as the description thereof is obvious in the light of the description of FIG. 13A. FIGS. 15B and 17B are merely top views of FIGS. 15A and 17A respectively but with the top covers 18' and end caps 19 snap-fitted to the panels and the connectors.

Figure 10:
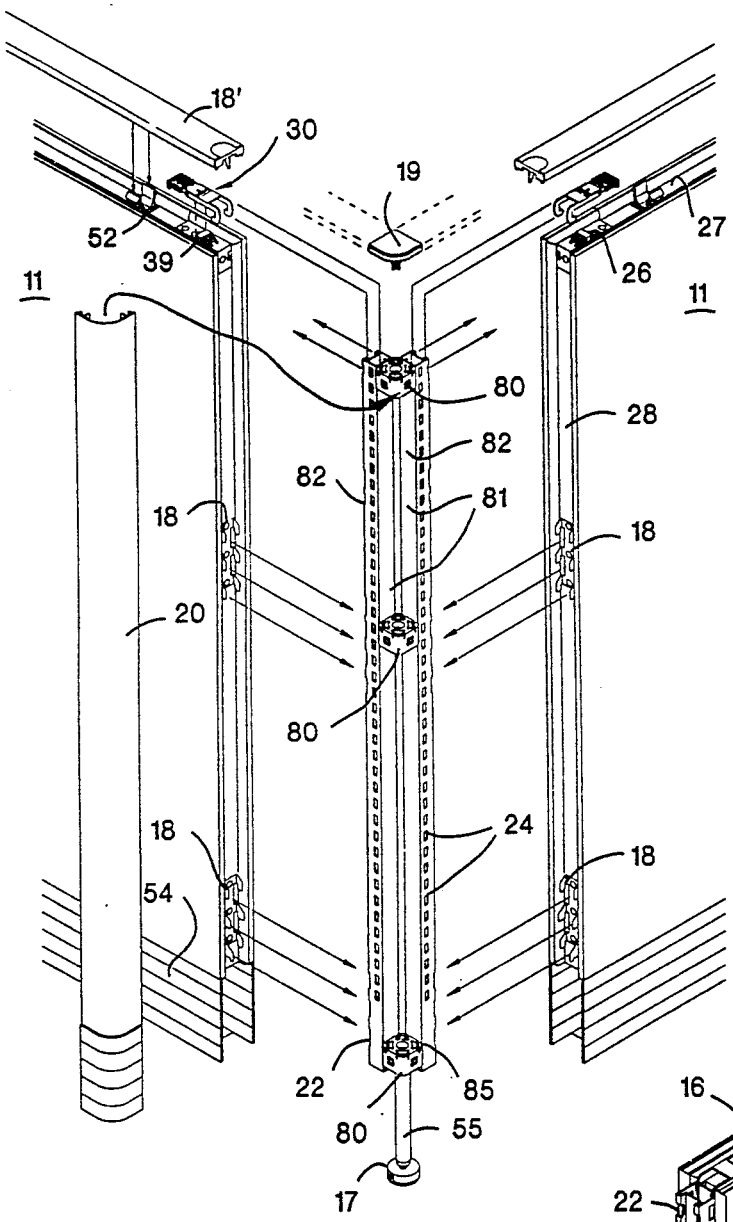
FIG. 10 is an exploded perspective view showing a panel connector of the present invention and connector blocks for interconnecting two panels at right angle to one another.
Figure 13A:
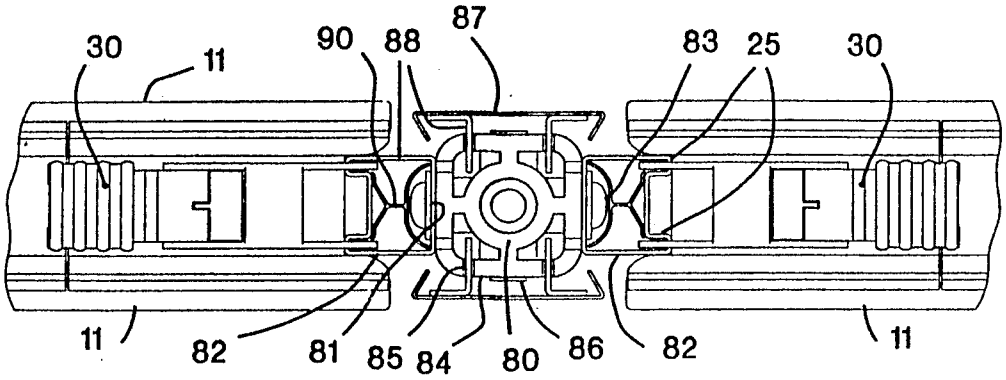
FIG. 13A is a top view showing two panels interconnected end to end with their structural connecting posts interconnected by connector blocks.
Figure 13B:
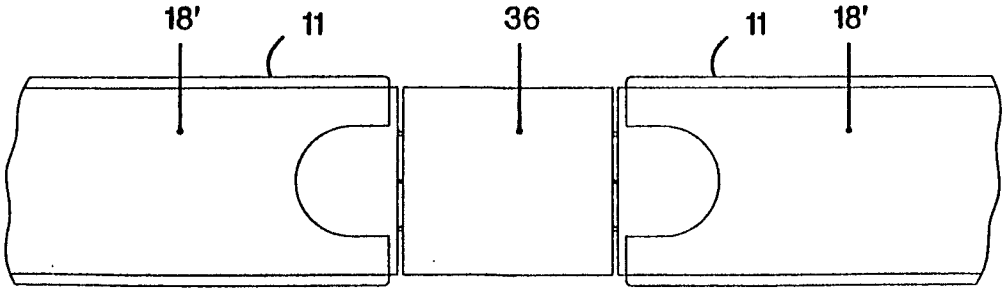
FIG. 13B is a top view of the joint connection of FIG. 13A but covered by panel covers and connector caps.

Referring now to FIG. 10, there is shown the manner in which these connecting blocks are secured to the connecting posts 82. As herein shown, connecting blocks are secured in opposed ends of the two posts with one being secured substantially midway therealong. An elongated vertical side cover 20 is then secured to the slots 85 of the connector blocks in a manner similar to that as shown in FIG. 13A where the cover strips 87 are secured. These cover strips 87 are provided with hooks 88 which engage within the slots 85 and held in position by their hooks. In order to remove the strips all one has to do is pull the strips upwardly and outwardly from the connecting blocks.

Figure 16A:
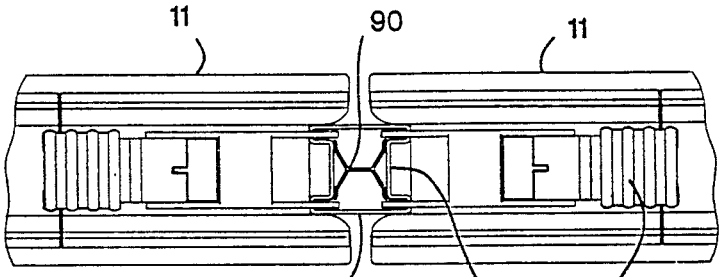
FIG. 16A is a top view showing two panels interconnected end to end in a common plane by a common structural connecting post.
Figure 16B:
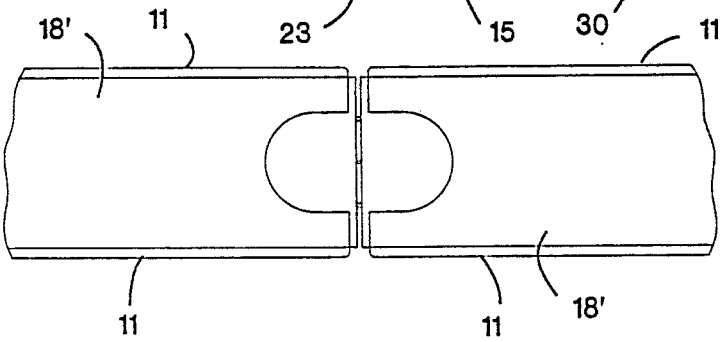
FIG. 16B is a top view similar to FIG. 16A but showing the panel/top covers in position.

FIG. 16A is a top view showing the connecting post of FIG. 5 connected to opposed panels 11. FIG. 16B shows the top cover plate 18' connected to the top edge of the panel 11. As shown in FIG. 16A, a shielding flexible strip 90 of opaque color or of a color matching that of the connector post 15 is slid from the top end of the connector post to mask the connecting slot 24 provided in the front end rear side walls 23 of the post 15. Other configuration of shielding strips, such as the strip 91, as shown in FIG. 17A is also used for the same purpose. FIG. 15A shows the two right-angle panels 11 of FIG. 10 interconnected together with a connector side cover 20 being secured to the square connecting blocks 80.

Figure 19B:
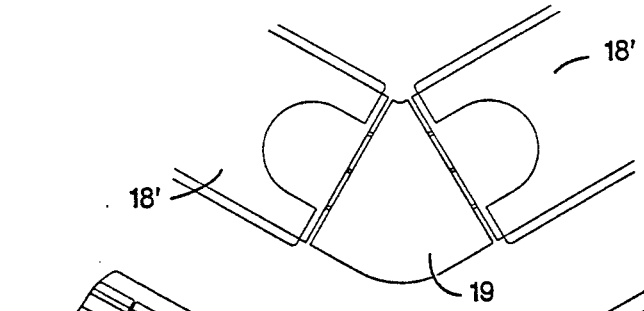
FIG. 19B is a top view of FIG. 19A but showing the panel top covers and the connector end caps in position.
Figure 19A:
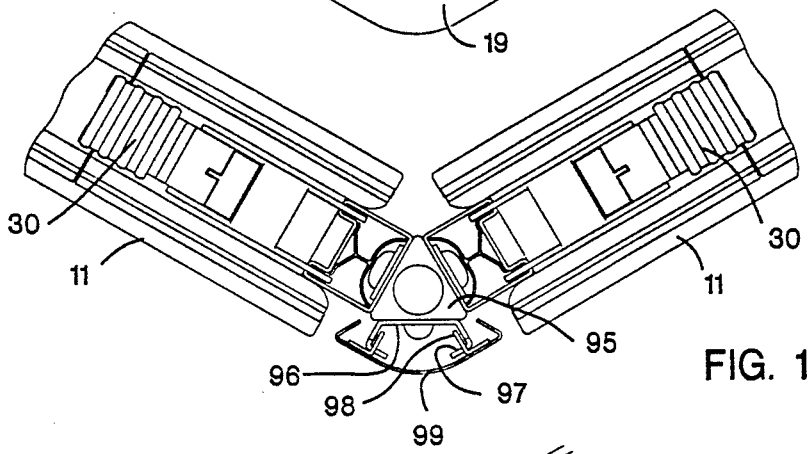
FIG. 19A is a top view showing two connecting posts and panels secured to a triangular connecting block and wherein the extend at angles to one another.
Figure 20B:
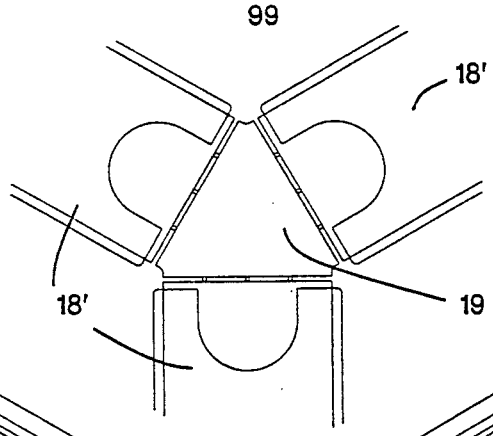
FIG. 20B is a top view similar to FIG. 20A but showing the panel top covers and connector end caps in position.
Figure 20A:
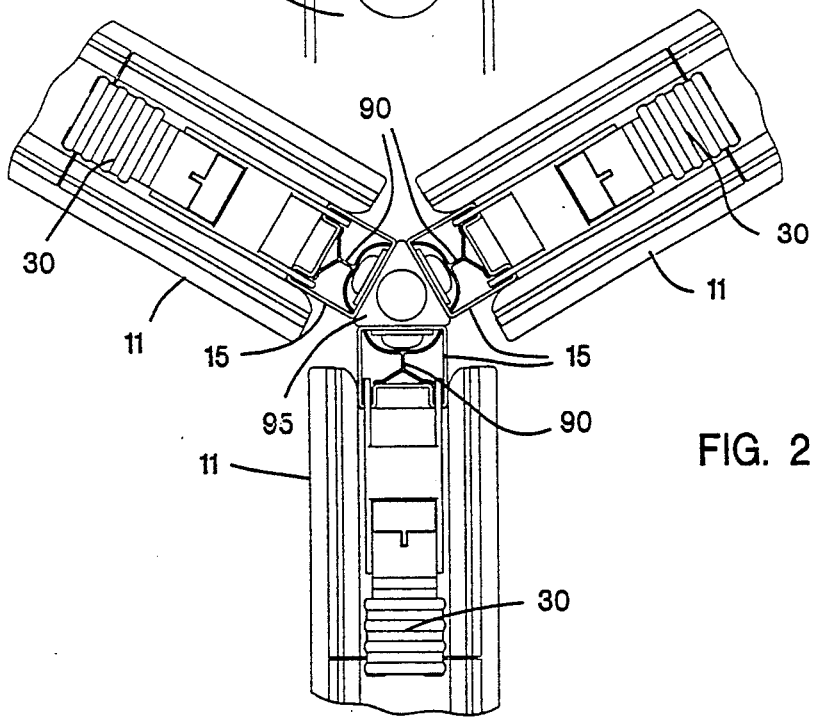
FIG. 20A is a top view showing three connecting posts interconnected by the triangular connecting block to interconnect three panels at 120° angles.

Referring now to FIGS. 19A and 20A, there is shown a triangular interconnecting block 95 for interconnecting two or three connecting posts, such as the post 82 at angles of 120° with respect to one another. These triangular connectors are constructed similarly to the square connectors with the exception that they are not provided with slots 85. Instead, a strip support connector 96 is secured to an open face of the triangular block and it is provided with slots 97 to receive the hooks 98 of an angle covering strip 99, as shown in FIG. 19A.

It is within the ambit of the present invention to cover any obvious modifications provided such modifications fall within the scope of the appended claims.

We claim:

1. A panel connector for interconnecting and supporting panels along their side edges to form a space division, said panel connector comprising a structural connecting post having a supporting bottom end and a securing top end, said connecting post having two pairs of opposed parallel side walls, a first pair of said side walls having panel attachment means in at least one side wall thereof and said other pair having a plurality of connecting means in at least one of its opposed side walls, a clamp bracket securable in a top corner of at least one panel to be secured to said connecting post, a clamp associated with said bracket and positioned over a portion of said clamp bracket disposed over a top wall of said panel, said clamp having fastening means to rigidly connect said panel attachment means to said clamp bracket to lock said panel with said panel attachment means of said connecting post, said clamp having a pivoting lever to permit said fastening means to be located in engagement with said attachment means of said connecting post and into arresting means of said clamp bracket to urge a side edge of said panel firmly against a side wall of said first pair of side walls of said connecting post, and hooking means secured to a connecting vertical edge of said panel for engagement with said panel attachment means of said connecting post and spaced from said top corner of said panel.

2. A panel connector as claimed in claim 1 wherein said clamp is a separate element detachably secured to a top wall of said clamp bracket, said top wall having a clamp post for connection with said pivoting lever.

3. A panel connector as claimed in claim 2 wherein said attachment means is constituted by hook receiving apertures provided in said first pair of said side walls, there being two or more of said hook receiving apertures spaced along said connecting post.

4. A panel connector as claimed in claim 3 wherein said fastening means is constituted by a hooking element, said hooking element having a bridge wall and a hooking finger for engagement in said hook receiving aperture for clamping said side wall of said connecting post against a connecting end face of said clamp bracket with said hooking finger engaging with said arresting means.

5. A panel connector as claimed in claim 4 wherein said arresting means is a hook receiving cavity provided in a flat vertical end face of said clamp bracket.

6. A panel connector as claimed in claim 5 wherein said clamp bracket is a right-angle bracket secured to said top corner of said panel, said bracket having a top wall to which said clamp is secured.

7. A panel connector as claimed in claim 6 wherein said clamp is a separate element detachably secured to a clamp post extending above said clamp top wall, said hooking element being pivotally secured to said pivoting lever spaced from a wedge end thereof, said wedge end being configured for locking abutment with said clamp post when said hooking element is engaged in said hook receiving aperture of said connecting post and said lever is pushed downwardly against said top wall of said bracket.

8. A panel connector as claimed in claim 7 wherein said hooking element is a pair of hooking fingers, said connecting post being a hollow post having protruding end channels formed along corner areas of said first pair of side walls, said hook receiving apertures being formed in pairs in outer end portions of said end channels and in transverse alignment with one another, said hooking fingers being received in a respective one of a pair of said hook receiving apertures with said bridge wall of each hooking element being captive in said end channels, there being two hook receiving cavities in said vertical end face of said clamp bracket to receive a respective free end of said hooking fingers therein.

9. A panel connector as claimed in claim 8 wherein said pair of hooking fingers are formed from a flat metal plate and are disposed spaced-apart in parallel relationship, said fingers each having a straight connecting arm, an interconnecting wall for interconnecting said fingers together, said connecting arms being pivotally connected at a pivotal end to said pivoting lever, said clamp post being received between said connecting arms when said lever is connected thereto.

10. A panel connector as claimed in claim 9 wherein said clamp post is provided with an undercut abutment wall for receiving said wedge end in locking engagement thereunder.

11. A panel connector as claimed in claim 10 wherein said lever is provided with a finger engaging end portion.

12. A panel connector as claimed in claim 10 wherein said lever is provided with a slot aperture in a free end wall thereof to permit entry of a wedging tool therein to disengage said lever from said clamp post by a lifting force on said lever free end.

13. A panel connector as claimed in claim 3 wherein said hooking means is a hook plate having two or more spaced-apart hooking fingers projecting therefrom to engage with two or more pairs of said hook receiving apertures spaced from said top corner of said panel.

14. A panel connector as claimed in claim 13 wherein said connecting post is provided with two or more groups of hook receiving apertures, at least one of said groups being spaced closely to a bottom end of said connecting post.

15. A panel connector as claimed in claim 14 wherein said connecting post has end channels formed along corner areas of said first pair of side walls, said hook receiving apertures being formed in pairs in outer end portions of said end channels and in transverse alignment with one another, said hook plate having at least one pair of hooking fingers to engage with a selected pair of hook receiving apertures of said groups.

16. A panel connector as claimed in claim 15 wherein said hook plate has a flat connecting wall for attachment to a flat vertical end wall of said panel, and at least two pairs of said hooking fingers formed integral with and spaced along said end wall for engagement with two pairs of hook receiving apertures of said groups.

17. A panel connector as claimed in claim 1 wherein said plurality of connecting means is comprised of a plurality of equidistantly spaced rectangular apertures provided along a major portion of said post, said rectangular apertures receiving supporting hook connectors of shelving panels or either furniture accessories to be supported by said post or two or more posts forwardly of said panel.

18. A panel connector as claimed in claim 17 wherein said connecting post is a hollow post, said rectangular apertures being masked by a shielding strip slidably disposed inside said post.

19. A panel connector as claimed in claim 6 in combination with a rectangular panel having opposed parallel flat front and rear surfaces, and opposed recessed narrow vertical side edges and a recessed narrow top edge, said angle bracket being secured to opposed top corners of said side and top edges, said hooking means being a hook plate having hooking fingers projecting therefrom there being at least one hook plate in each opposed vertical side edges, and cover means removably secured over exposed ones of said recessed side edge and said recessed top edge to conceal said clamps and said hook plates.

20. A panel connector as claimed in claim 3 wherein there is further provided spaced apart interconnecting blocks secured spaced apart to a flat side wall of said first pair of side walls whereby to interconnect two or more of said connecting posts in a side-by-side relationship.

21. A panel connector as claimed in claim 20 wherein said connecting block is a square block interconnecting two, three or four connecting posts along parallel vertical axes and associated panels at right angles to one another.

22. A panel connector as claimed in claim 20 wherein said connecting block is a triangular block interconnecting two or three connecting posts and associated panels at angles to one another and along parallel vertical axes.

23. A panel connector as claimed in claim 20 wherein said connecting block is provided with attachment means whereby to secure a connector cover strip thereto throughout the length of said connecting posts.

24. A panel connector as claimed in claim 8 wherein said connecting post is formed from interconnected post sections, one of said connecting post sections having a straight anchor tongue protruding from between said end channels in one of said first pair of side walls, said anchor tongue having an anchor bushing at a free end thereof with flexible arms having engaging shoulders to engage under a pair of said hook receiving apertures in said end channels of an aligned connecting post section, said apertures extending into opposed parallel walls of said channels.

25. A panel connector as claimed in claim 6 wherein a panel is secured to each of opposed ones of said first pair of side walls of said connecting post, said panels being of different height, said panels having cover plates removably secured along their top edge, and a vertical post cover secured to said connecting post side wall exposed above said panel of lower height.

26. A panel connector as claimed in claim 25 wherein two or more panels are secured to a respective one of said first pair of side walls of said connecting post, some of said panels being transparent or ventilated panels.

27. A panel connector as claimed in claim 1 wherein said supporting bottom end of said connecting post is provided with a leveling foot, to adjust the leveling of one or more panels connected to said connecting post, said leveling foot having an adjustment screw in threaded engagement in a lower end of said connecting post, said adjustment screw being secured to a rotatable block rotatably supported on a gripper base, said gripper base having gripper means in a lower surface thereof.

28. A panel connector as claimed in claim 27 wherein said rotatable block is provided with two or more lateral bores in a sidewall thereof to permit insertion of a rod-like element therein and adjacent a floor surface to rotate said block over said gripper base to thereby rotate said adjustment screw to lower or raise said connecting post and panel(s) connected thereto.

29. A panel connector as claimed in claim 28 wherein said gripper base is a flat nylon disc having sharp cone-shaped prongs extending from its said lower surface to constitute said gripper means, and a pivot connection interconnecting said disc to said block.

* * * * *